US009283447B1

(12) United States Patent
DeMille et al.

(10) Patent No.: US 9,283,447 B1
(45) **Date of Patent: *Mar. 15, 2016**

(54) GOLF CLUB HEAD WITH COMPOSITE FACE

(71) Applicant: Callaway Golf Company, Carlsbad, CA (US)

(72) Inventors: Brandon D. DeMille, Carlsbad, CA (US); Steven M. Ehlers, Poway, CA (US)

(73) Assignee: Callaway Golf Company, Carlsbad, CA (US)

( * ) Notice: Subject to any disclaimer, the term of this patent is extended or adjusted under 35 U.S.C. 154(b) by 149 days.

This patent is subject to a terminal disclaimer.

(21) Appl. No.: 14/158,963

(22) Filed: Jan. 20, 2014

Related U.S. Application Data

(60) Provisional application No. 61/881,159, filed on Sep. 23, 2013.

(51) Int. Cl.
*A63B 53/04* (2015.01)

(52) U.S. Cl.
CPC ..... *A63B 53/04* (2013.01)

(58) Field of Classification Search
CPC ..... A63B 53/04; A63B 53/0466; A63B 2053/0416; A63B 2053/0425; A63B 2053/0429; A63B 2053/042
USPC ..... 473/287–292, 324–350
See application file for complete search history.

(56) References Cited

U.S. PATENT DOCUMENTS

| | | | | | |
|---|---|---|---|---|---|
| 1,562,956 | A * | 11/1925 | Guerne | A63B 53/04 | 473/329 |
| 3,975,023 | A * | 8/1976 | Inamori | A63B 53/04 | 473/329 |
| 4,581,190 | A * | 4/1986 | Nagamoto | A63B 53/04 | 264/136 |
| 5,310,185 | A * | 5/1994 | Viollaz | A63B 53/04 | 273/DIG. 23 |
| 5,398,929 | A * | 3/1995 | Kitaichi | A63B 53/04 | 473/329 |
| 5,403,007 | A * | 4/1995 | Chen | A63B 53/04 | 473/342 |
| 5,417,419 | A * | 5/1995 | Anderson | A63B 53/04 | 228/125 |
| 5,445,382 | A * | 8/1995 | Pearce | A63B 53/04 | 273/DIG. 23 |
| 5,447,311 | A * | 9/1995 | Viollaz | A63B 53/04 | 473/329 |
| 5,524,331 | A | 6/1996 | Pond | | |
| 5,637,045 | A * | 6/1997 | Igarashi | A63B 53/04 | 273/DIG. 8 |
| 6,334,818 | B1 * | 1/2002 | Cameron | A63B 53/04 | 473/332 |
| 6,364,789 | B1 * | 4/2002 | Kosmatka | A63B 53/04 | 473/329 |
| 6,428,427 | B1 | 8/2002 | Kosmatka | | |
| 6,435,977 | B1 | 8/2002 | Helmstetter et al. | | |

(Continued)

*Primary Examiner* — Sebastiano Passaniti
(74) *Attorney, Agent, or Firm* — Rebecca Hanovice; Michael Catania; Sonia Lari

(57) ABSTRACT

A novel material comprising collections of prepreg plies and a variable thickness core material such as sheet molding compound or metal, methods of forming said material, and golf clubs comprising said material are disclosed herein.

9 Claims, 6 Drawing Sheets

(56) References Cited

U.S. PATENT DOCUMENTS 6,443,857 B1 * 9/2002 Chuang ..... A63B 53/04 473/332
6,769,998 B2 * 8/2004 Clausen ..... A63B 53/0466 473/342
7,267,620 B2 9/2007 Chao
7,628,712 B2 12/2009 Chao et al.
7,862,452 B2 1/2011 Chao et al.
7,871,340 B2 1/2011 Chao et al.
7,874,936 B2 1/2011 Chao
7,874,937 B2 1/2011 Chao
7,874,938 B2 1/2011 Chao
RE42,544 E 7/2011 Chao et al.
7,985,146 B2 7/2011 Lin et al.
8,007,369 B2 * 8/2011 Soracco ..... A63B 53/0466 473/332
8,092,318 B2 * 1/2012 Oldknow ..... A63B 53/04 473/329
8,096,897 B2 1/2012 Beach et al.
8,163,119 B2 4/2012 Chao
8,221,261 B2 7/2012 Curtis et al.
RE43,801 E 11/2012 Chao et al.
8,303,435 B2 11/2012 Chao
8,444,504 B2 5/2013 Chao et al.
8,628,434 B2 1/2014 Chao
8,684,864 B2 4/2014 Lin et al.
8,747,250 B2 6/2014 Chao et al.
8,777,776 B2 7/2014 Wahl et al.
8,876,629 B2 11/2014 Golden et al.
8,882,609 B2 11/2014 Boyd et al.
9,033,818 B2 * 5/2015 Myrhum ..... A63B 53/0466 473/329
9,033,822 B1 * 5/2015 DeMille ..... A63B 53/0466 473/345
2009/0163289 A1 6/2009 Chao
2012/0199282 A1 8/2012 Chao
2013/0040754 A1 * 2/2013 Morin ..... A63B 53/04 473/329
2013/0040756 A1 * 2/2013 Myrhum ..... A63B 53/0466 473/342
2013/0040757 A1 * 2/2013 Deshmukh ..... A63B 53/0466 473/342
2013/0190102 A1 7/2013 Greaney et al.
2013/0225321 A1 * 8/2013 Myrhum ..... A63B 53/0466 473/342
2014/0128176 A1 5/2014 Chao
2014/0148271 A1 * 5/2014 Myrhum ..... A63B 53/04 473/342
2014/0171216 A1 6/2014 Lin et al.
2014/0256464 A1 9/2014 Chao et al.
2014/0256467 A1 9/2014 Lorentzen et al.
2014/0274446 A1 9/2014 Greaney et al.
2014/0295991 A1 10/2014 Chao et al.

* cited by examiner

GOLF CLUB HEAD WITH COMPOSITE FACE

CROSS REFERENCES TO RELATED APPLICATIONS

The present application claims priority to U.S. Provisional Patent Application No. 61/881,159, filed on Sep. 23, 2013, the disclosure of which is hereby incorporated by reference in its entirety herein.

STATEMENT REGARDING FEDERALLY SPONSORED RESEARCH OR DEVELOPMENT

Not Applicable

BACKGROUND OF THE INVENTION

1. Field of the Invention

The present invention relates to a multiple material golf club head. More specifically, the present invention relates to a golf club head with a face comprising a composite material.

2. Description of the Related Art

The prior art discloses several different composite golf club face concepts. For example, U.S. Pat. Nos. 5,310,185, 6,607,623, 6,612,938, 7,267,620, 7,628,712, 7,850,546, 7,862,452, 7,871,340, 8,096,897, and 8,163,119, disclose face inserts or face components formed of multiple prepreg plies, while U.S. Pat. Nos. 7,874,936, 7,874,937, 7,874,938, and 8,303,435, disclose face plates composed of multiple composite prepreg plies and prepreg strips to achieve variable face thickness.

Prepreg plies are not the ideal materials to use for golf club face construction, however, because using these materials to create the variable face thickness patterns that are demanded by consumers can be time consuming (the plies must be oriented by hand in a mold), expensive (the cost of plies can be high), and wasteful (scrap parts of the plies cannot easily be reused). Therefore, there is a need for improved materials and methods to create composite golf club faces.

BRIEF SUMMARY OF THE INVENTION

One aspect of the present invention is a composition comprising a first plurality of prepreg plies (collectively known as a laminate), a second plurality of prepreg plies, and a variable thickness core material, wherein the variable thickness core material is permanently sandwiched between the first plurality of prepreg plies and the second plurality of prepreg plies, and wherein the composition comprises a variable thickness pattern. The variable thickness core material may be selected from a group consisting of sheet molding compound, metal, and polymeric material, and in some embodiments may be sheet molding compound. In some embodiments, the thickness of the composition may be continuously variable. In a further embodiment, a golf club head may comprise a component composed of this composition, and the component may be selected from the group consisting of a face cup, a face insert, a face plate, a sole, and a crown.

Another aspect of the present invention is a golf club head comprising a body comprising a top portion, a bottom portion, and a face portion, and a first patch composed of the composition described above, wherein the first patch is affixed to the face portion. In some embodiments, the first patch may be custom molded onto the face portion, while in other embodiments, the first patch may be affixed to the face portion with an adhesive material. In some embodiments, the face portion may be composed of a metal material. In other embodiments, at least one of the face portion and the first patch may comprise a variable thickness pattern. In some embodiments, the first patch may be affixed to one of an inner surface and an outer surface of the face portion. In a further embodiment, the first patch may be affixed to an inner surface of the face portion and a second patch composed of the composition described above may be affixed to an outer surface of the face portion. In another embodiment, the face portion may comprise a recess sized to receive the first patch.

Yet another aspect of the present invention is a method comprising providing first and second pluralities of prepreg materials, providing a sheet molding compound, forming a combination material from the first and second pluralities of prepreg materials and the sheet molding compound, shaping the combination material into a patch, and affixing the patch to a surface of a golf club head. In some embodiments, the step of forming a combination material may be selected from the group consisting of co-molding the first and second pluralities of prepreg materials with the sheet molding compound or bonding the first and second pluralities of prepreg materials to the sheet molding compound. In one embodiment, the step of affixing the patch to a surface of the golf club head may comprise custom-molding the patch onto the surface of the golf club head. In another embodiment, the step of affixing the patch to a surface of the golf club head may comprise bonding the patch onto the surface of the golf club head with an adhesive material.

Another aspect of the present invention is a method comprising providing first and second pluralities of prepreg plies, providing a variable thickness core compound, sandwiching the variable thickness core compound between the first and second pluralities of prepreg plies to form a combination material, shaping the combination material into a patch, and co-molding the patch to a surface of a golf club head. In some embodiments, the step of sandwiching the variable thickness core compound between the first and second pluralities of prepreg plies may further comprise the step of co-molding the variable thickness core compound with the first and second pluralities of prepreg plies.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

The present invention provides a solution to the problems set forth above by providing a preferred, combination composite material that can be used to more efficiently make structurally sound golf club parts, including face cups, face inserts, face plates, face patches, soles, crowns, and other parts that require specific and/or continuously variable thicknesses. The present invention also provides face structures that incorporate the novel composite material. The present invention may also be used to make parts for products and devices other than golf clubs.

Figure 1:
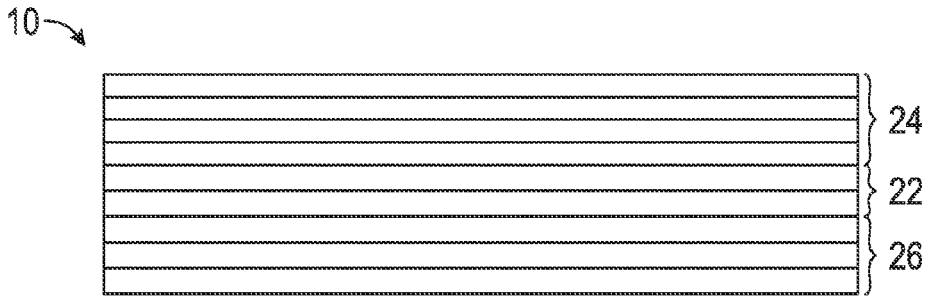
FIG. 1 (Prior Art)
FIG. 1 is a line drawing of a prior art laminate material with constant thickness.
Figure 2:
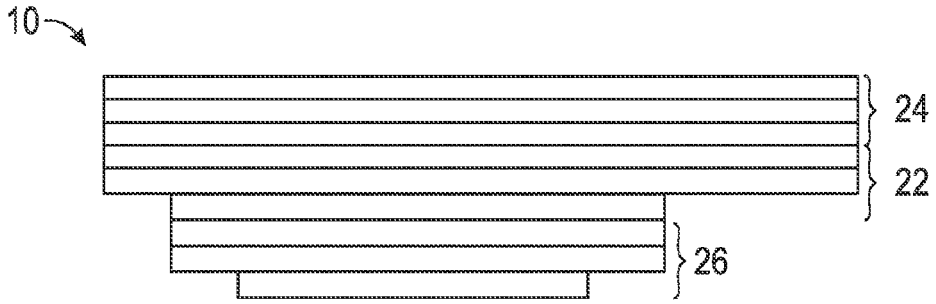
FIG. 2 (Prior Art)
FIG. 2 is a line drawing of a prior art laminate material with discrete thicknesses.
Figure 3:
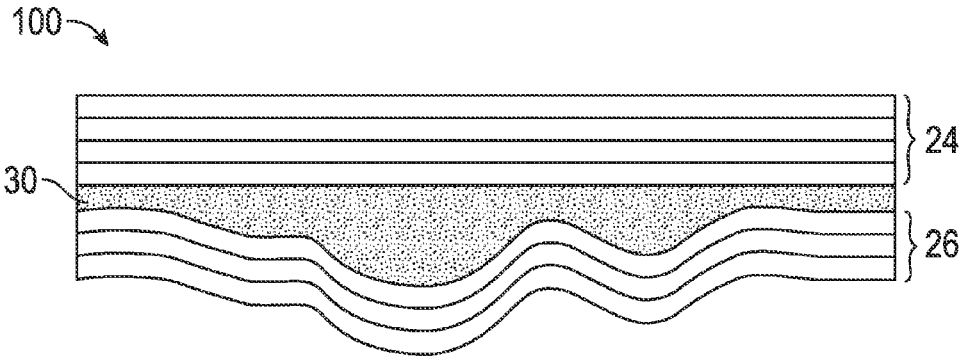
FIG. 3 is a line drawing of the combination composite material of the present invention.

As shown in FIGS. 1 and 2, the composite material 10 used to create prior art composite golf club faces typically is made up of multiple prepreg plies 20. Collections of prepreg plies are also referred to as laminates herein. These plies include collections of core-level plies 22, exterior plies 24, and interior plies 26. As noted above, it is both time consuming and expensive to create thickness changes in composite parts when using layers of prepreg plies. The inventive material 100 of the present invention is novel because, as shown in FIG. 3, the core-level plies 22 are replaced with a core 30 comprising sheet molding compound (also referred to herein as SMC), which may be one of the sheet molding compounds disclosed in U.S. patent application Ser. No. 13/912,994, the disclosure of which is hereby incorporated by reference in its entirety herein, or a titanium alloy. For example, the sheet molding compound may comprise bundles of thousands of aligned carbon fibers that are pre-spread and then are randomly assorted and combined with a matrix material. The sheet molding compound may also include carbon nanotubes, nanoclays, and other micro- and nano-fillers to increase the material properties of the compound, and can be reinforced with fibers such as carbon, fiberglass, aramid, and combinations of the three. Other materials that can be manufactured easily into desired shapes with variable thicknesses may also be combined with or used instead of SMC or titanium. Polymers, other metals, foams, honeycomb structures, wood, and fiber reinforced polymers may all be used as variable thickness core 30 materials. Manufacturing methods for variable thickness cores 30 include casting, forging, injection molding, metal injection molding, die casting and machining.

Figure 11:
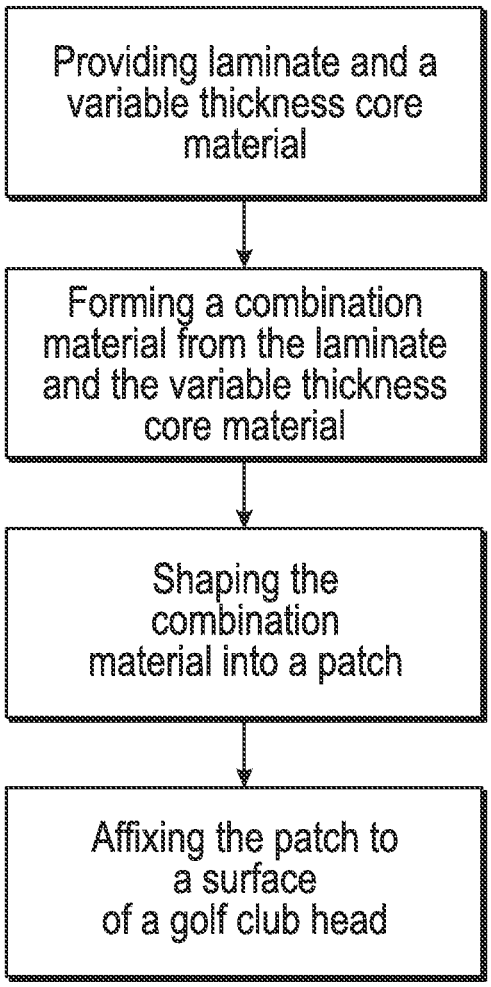
FIG. 11 is a flow chart showing a preferred method of the present invention.

Once the variable thickness core 30 is formed, the pluralities of prepreg plies 24, 26 (collectively laminates) and the core 30 can be combined in several ways. In a first process, the inventive material 100 can be co-molded, in which case the pluralities of prepreg plies 24, 26 are pressed together around the core 30 during their cure cycle. A second process involves curing the core 30 piece separately, then pressing the collections of prepreg plies 24, 26 onto the core 30 in a separate cure cycle. An adhesive layer may also be added between the core 30 and the collections of prepreg plies 24, 26. A third process is to mold the core 30 and the outer collections of prepreg plies 24, 26 completely separately, and then bond them together afterwards. Similar options exist for titanium variable thickness cores 30. The collections of prepreg plies 24, 26 can be molded directly onto the titanium with or without an adhesive layer. This method is preferable for titanium variable thickness cores 30 because it allows for custom molding of the collections of prepreg plies 24, 26 onto each golf club head casting, which ensures a perfect fit between the parts, even if the casting has some dimensional variation. The collections of prepreg plies 24, 26 can also be molded separately and then bonded to the titanium. A flow chart showing a high-level process of creating and using the inventive material 100 is shown in FIG. 11.

Variable thickness cores 30 are preferable to prepreg plies because the thicknesses of the materials used to make these cores 30, including but not limited to SMC and metals (including titanium), are easier to manipulate than that of laminate or layers of prepreg plies. SMC also is cheaper than prepreg plies. When a prior art composite material comprising only laminate or multiple layers of prepreg plies is subject to bending forces, the deformation of the material is influenced the most by the stiffness of the collections of exterior and interior prepreg plies 24, 26, while the properties of the core-level prepreg plies 22 are not nearly as important to the structural integrity of the material. In other words, the prepreg plies at the center of a part composed entirely of prepreg plies have much less of an influence on bending stiffness and strength of the part than do its outer layers. Replacing the core-level plies 22 with a core 30 made of a more easily/cheaply made variable thickness material thus allows a manufacture to fine-tune a golf club part's thicknesses without adding additional plies or layers (which must be hand-placed in a mold), while at the same time using collections of prepreg plies 24, 26 on the inside and outside surfaces of the part where they can have the most influence on the structure of that part. The inventive material 100 thus allows a golf club manufacturer to make more complicated and/or continuously variable thickness patterns, an example of which is shown in FIG. 3, especially in golf club faces, without sacrificing structural integrity of the face and without wasting the time, material, and money that is required when working only with laminates or collections of prepreg plies.

The bending stiffness (D) of the inventive material 100 can be altered using variable thickness patterns and by changing the orientation of its collections of prepreg plies 24, 26. If the prepreg plies are oriented properly, the inventive material 100 can be stiff in one direction and compliant in another, thus positively affecting launch angle robustness, backspin robustness, and off-center ball speed when the inventive material 100 is used to form a golf club face. In an A-B-D matrix that satisfies the force/moment to strain/curvature relationship:

$$\begin{bmatrix} N \\ M \end{bmatrix} = \begin{bmatrix} A & B \\ B & D \end{bmatrix} \begin{bmatrix} \varepsilon^o \\ \kappa \end{bmatrix} \text{ where}$$

$$[D] = \begin{bmatrix} Dxx & Dxy & Dxs \\ Dyx & Dyy & Dys \\ Dsx & Dsy & Dss \end{bmatrix}$$

prepreg plies, variable thickness patterns, and combinations of the two can be chosen such that Dxx is significantly different from Dyy.

The A-B-D matrix represents the relationship between loads and bending moments to strains and curvatures. N represents forces, M represents bending moments, $\epsilon^0$ represents strains, and K represents curvatures. The x-direction typically is defined as the projection of the heel-toe direction onto the face. The y-direction also is on the surface of the face and perpendicular to the x-direction. The z-direction is the direction through the thickness of the collections of prepreg plies and face. Golf club faces are not perfectly circular, so an optimal face does not have the same bending stiffness in every direction. Launch conditions and launch condition robustness (launch angle, back spin, side spin, ball speed) can be improved by creating faces with the appropriate bending stiffness in each direction and each location on the face. In some embodiments, a face formed from or including the inventive material 100 may satisfy one or both of the following equations:

$$\frac{Dxx}{Dyy} > C$$

$$\frac{Dyy}{Dxx} > C$$

wherein C can range from 1.00 to 1.50, and more preferably from 1.05 to 1.10.

Figure 4:
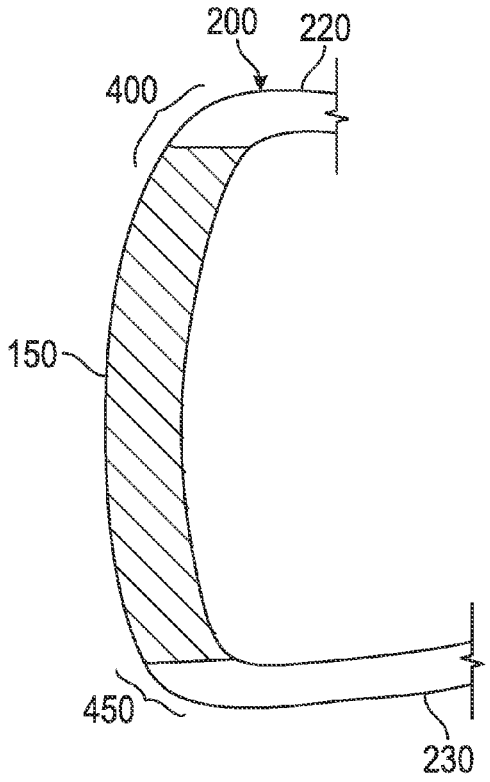
FIG. 4. is a cross-sectional view of a first embodiment of a golf club head of the present invention.

An exemplary golf club face insert 150 made from the inventive material 100 is shown in FIG. 4 in combination with a golf club head 200, which may be a driver, fairway wood, iron, hybrid, or putter head, but preferably is a driver. In a further embodiment, shown in FIG. 5, the face insert 150 includes a recess 155 in its inner or outer surfaces 151, 152 to receive a reinforcement plate 270. This embodiment may be particularly attractive to a golfer who wishes to continue using a golf club head 200 with a metallic face but wants a golf club head 200 with lower overall weight. Golfers who like visible technology in their golf clubs will also appreciate the fact that the inventive material 100 is visible in this embodiment. In an alternative embodiment, shown in FIG. 6, a metal plate or cap 280 covers the entire outer surface 152 of the face insert 150, and holes or slots 281, 282 are drilled into or otherwise formed in the cap 280 so that the inventive material 100 is visible to a consumer. These holes or slots 281, 282 can be filled with another material, such as the inventive material 100 or another lightweight material known to a person skilled in the art.

Figure 7A:
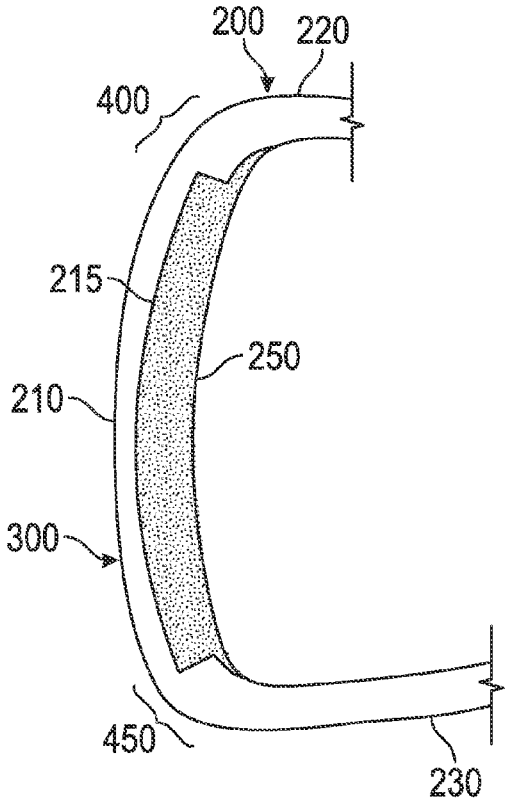
FIG. 7A is a cross-sectional view of a fourth embodiment of a golf club head of the present invention.
Figure 7B:
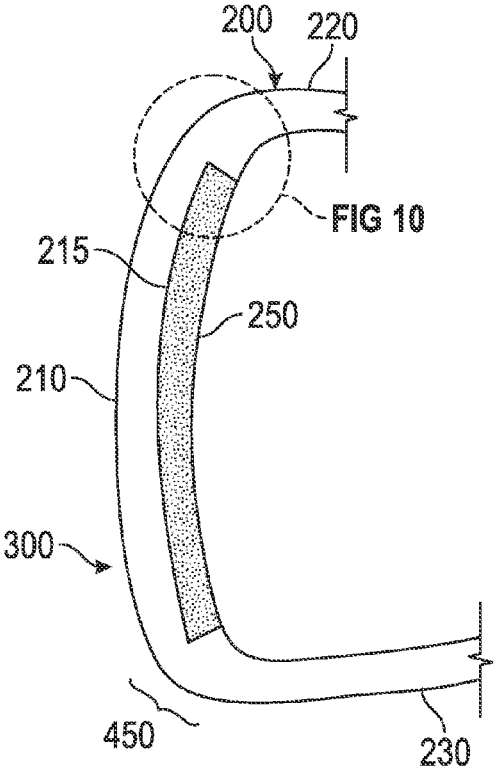
FIG. 7B is a cross-sectional view of a fifth embodiment of a golf club head of the present invention.
Figure 8:
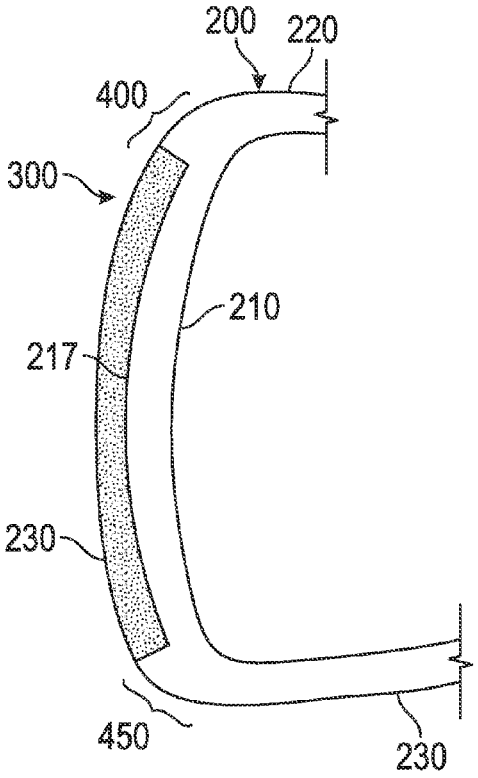
FIG. 8 is a cross-sectional view of a sixth embodiment of a golf club head of the present invention.
Figure 9:
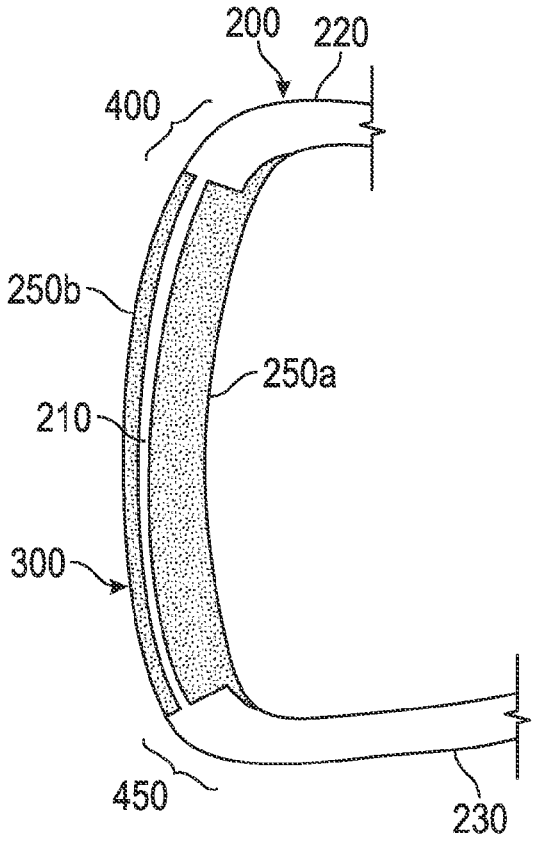
FIG. 9 is a cross-sectional view of a seventh embodiment of a golf club head of the present invention.

The inventive material 100 can also be used to make other face components, such as face plates, face cups, face patches, and other golf club head parts. For example, a patch 250 of the inventive material 100 can be affixed to an inside surface 215 of a face 210 as shown in FIGS. 7A and 7B or on an outside surface 217 of a face 210 as shown in FIG. 8. In another embodiment, multiple patches 250*a*, 250*b* are fixed to both the inside and outside surfaces 215, 217 of a face 210 as shown in FIG. 9. The patch 250 may be affixed to the face 210 by any means known to a person skilled in the art, including via adhesives and mechanical fasteners, but it is most preferable to custom mold the patch 250 onto the face 210. When a patch 250 of the inventive material 100 is custom molded onto a golf club face 210, it reduces or eliminates the need for a separate adhesive layer between the face 210 and the patch 250 and guarantees a perfect fit between the patch 250 and any part with which it is molded. In each of these embodiments, the face 210 preferably is composed of a metal material, such as stainless steel or titanium alloy.

Figure 5:
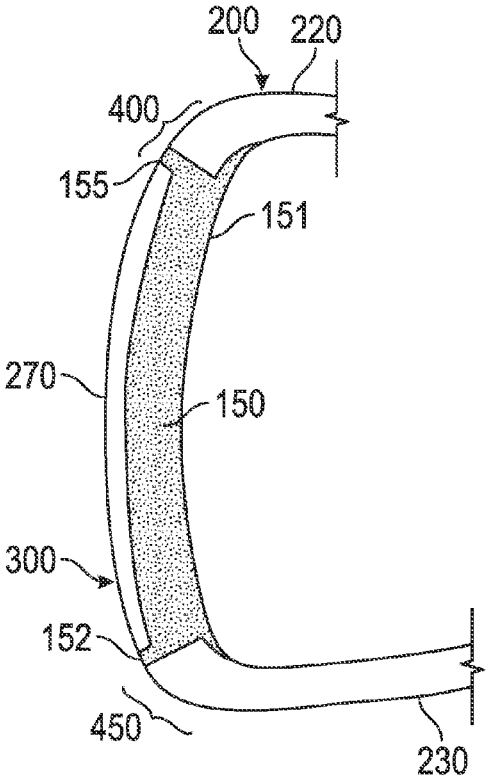
FIG. 5 is a cross-sectional view of a second embodiment of a golf club head of the present invention.
Figure 6:
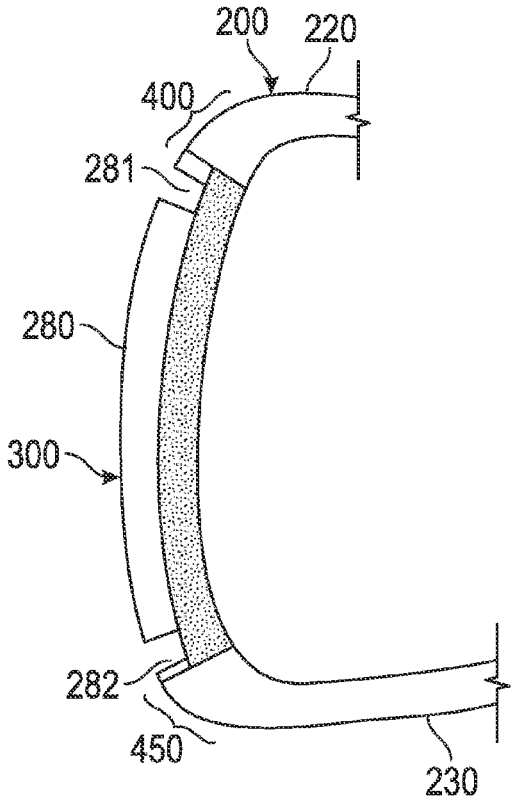
FIG. 6 is a cross-sectional view of a third embodiment of a golf club head of the present invention.

In each of the embodiments shown in FIGS. 5-9, the overall thickness of the resulting golf club striking face 300 is controlled by varying the thickness of the metal face 210, the variable thickness core (e.g., SMC or metal) material included in the inventive material 100, or both. In each of the embodiments shown in these Figures, the patch 250 can be smoothly blended with the surface of the golf club head 200 to which it is attached, as shown in FIGS. 5, 7A, and 9 (with respect to the rear patch 250*a*), or disposed entirely within a recess or cavity, as shown in FIGS. 7B, 8, and 9 (with respect to the front patch 250*b*).

Figure 10:
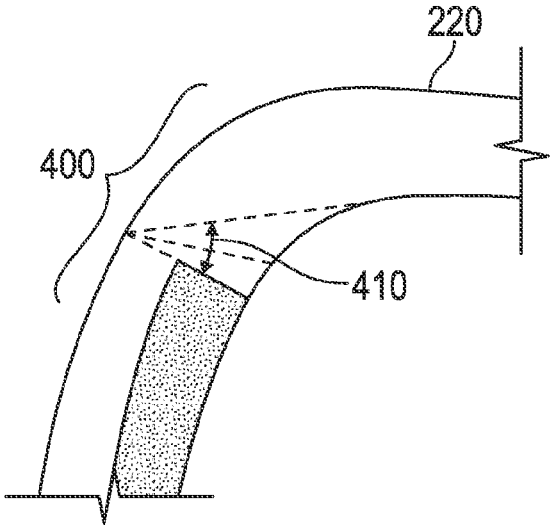
FIG. 10 is an enlarged view of the circled portion of FIG. 7B.

In each of the embodiments disclosed herein, the joint angles 410 and configurations in the hinge regions 400, 450, defined as the regions where the face transitions into the crown 220 and sole 230, an example of which is shown in FIG. 10, preferably are custom tailored to allow for efficient stress transfer and a more gradual transition from the fully metallic composition of crown 220 and sole 230 portions of the club head 200 to the metallic and composite composition of the face.

In any of the embodiments disclosed herein, holes and/or slots may be drilled into or otherwise included in the metal face 210 portion of the club head 200, and can be filled with something less dense than the original material in order to reduce the overall weight of the golf club head 200. The filler material may be a lightweight metal such as aluminum or magnesium, or a thermoset or thermoplastic material. The holes and slots may go part of the way through the thickness of the metal face 210, or may extend all the way through the face 210 before the patch 250 disclosed herein is added.

The golf club parts, and particularly the faces, disclosed herein preferably have a variable thickness pattern, which may be any of the patterns disclosed in U.S. Pat. Nos. 5,163,682, 5,318,300, 5,474,296, 5,830,084, 5,971,868, 6,007,432, 6,338,683, 6,354,962, 6,368,234, 6,398,666, 6,413,169, 6,428,426, 6,435,977, 6,623,377, 6,997,821, 7,014,570, 7,101,289, 7,137,907, 7,144,334, 7,258,626, 7,422,528, 7,448,960, 7,713,140, 8,012,041, and 8,376,876, the disclosure of each of which is incorporated in its entirety herein. The golf club parts disclosed herein may also have the variable face thickness patterns disclosed in U.S. Patent Application Publication No. 20120021849, the disclosure of which is incorporated in its entirety herein.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim:

1. A golf club head comprising a component composed of a composition comprising:

a first plurality of prepreg plies;

a second plurality of prepreg plies; and a variable thickness core material, wherein the variable thickness core material is permanently sandwiched between the first plurality of prepreg plies and the second plurality of prepreg plies, wherein the variable thickness core comprises a sheet molding compound comprising bundles of aligned carbon fibers and at least one reinforcing fiber material, wherein the carbon fiber bundles have random orientations within the sheet molding compound, wherein the carbon fiber bundles are pre-spread prior to being processed into the sheet molding compound, wherein the at least one reinforcing fiber material is selected from the group consisting of carbon, fiberglass, and aramid, wherein the component comprises a variable thickness pattern, wherein the component satisfies at least one equation selected from the group consisting of $$\frac{Dxx}{Dyy} > C$$

and $$\frac{Dyy}{Dxx} > C,$$

and wherein C is at least 1 and is no more than 1.5.

2. The golf club head of claim 1, wherein the component is selected from the group consisting of a face cup, a face insert, a face plate, a sole, and a crown.

3. A golf club head comprising:

a body comprising a top portion, a bottom portion, and a face portion; and a first patch composed of a composition comprising:

a first plurality of prepreg plies;

a second plurality of prepreg plies; and a variable thickness core material, wherein the variable thickness core material is permanently sandwiched between the first plurality of prepreg plies and the second plurality of prepreg plies, wherein the variable thickness core material comprises a sheet molding compound comprising bundles of aligned carbon fibers and at least one reinforcing fiber material, wherein the carbon fiber bundles have random orientations within the sheet molding compound, wherein the carbon fiber bundles are pre-spread prior to being processed into the sheet molding compound, wherein the at least one reinforcing fiber material is selected from the group consisting of carbon, fiberglass, and aramid, wherein the first patch is affixed to an inner surface of the face portion, and wherein the face portion comprises at least one hole through which a portion of the first patch is visible.

4. The golf club head of claim 3, wherein the first patch is custom molded onto the face portion.

5. The golf club head of claim 3, wherein the first patch is affixed to the face portion with an adhesive material.

6. The golf club head of claim 3, wherein the face portion is composed of a metal material.

7. The golf club head of claim 3, wherein at least one of the face portion and the first patch comprises a variable thickness pattern.

8. The golf club head of claim 3, further comprising a second patch composed of the composition, wherein the second patch is affixed to an outer surface of the face portion.

9. The golf club head of claim 3, wherein the face portion comprises a recess sized to receive the first patch.

* * * * *